US006916216B2

(12) United States Patent
Matsuda et al.

(10) Patent No.: US 6,916,216 B2
(45) Date of Patent: Jul. 12, 2005

(54) SMALL WATERCRAFT

(75) Inventors: Yoshimoto Matsuda, Kobe (JP); Yasuo Okada, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/646,956

(22) Filed: Aug. 21, 2003

(65) Prior Publication Data

US 2004/0099193 A1 May 27, 2004

(30) Foreign Application Priority Data

Aug. 27, 2002 (JP) ..... 2002-246437

(51) Int. Cl.[7] ..... B63H 20/08
(52) U.S. Cl. ..... 440/55.5; 440/88 L
(58) Field of Search ..... 114/55.5; 440/88 L

(56) References Cited

U.S. PATENT DOCUMENTS 6,743,063 B2 * 6/2004 Gokan ..... 440/88 L

FOREIGN PATENT DOCUMENTS

DE 3832013 A1 * 3/1990 ..... F01M/1/04

* cited by examiner

*Primary Examiner*—Jesus D. Sotelo
(74) *Attorney, Agent, or Firm*—Alleman Hall McCoy Russell & Tuttle LLP

(57) ABSTRACT

A small watercraft comprises an engine for propelling a body of the watercraft, an oil tank configured to reserve oil for lubricating the engine, an oil separator configured to separate the oil from a blow-by gas of the engine, and an oil return passage configured to return the separated oil to the oil tank, wherein a baffle member is provided in the vicinity of an opening portion at which the oil return passage opens in the oil tank so as to inhibit the oil from moving from a predetermined direction toward the opening portion of the oil return passage within the oil tank.

11 Claims, 7 Drawing Sheets

SMALL WATERCRAFT

BACKGROUND OF THE INVENTION

1. Field of the Invention

The present invention relates to a small watercraft. More particularly, the present invention relates to a structure of an oil return port from an oil separator of a breather mechanism of an engine to an oil tank.

2. Description of the Related Art

In recent years, so-called jet-propulsion personal watercraft, which are one type of small watercraft, have been widely used in leisure, sport, rescue activities, and the like. The personal watercraft is configured to have a water jet pump that pressurizes and accelerates water sucked from a water intake generally provided on a bottom hull surface and ejects it rearward from an outlet port. Thereby, the personal watercraft is propelled.

In the personal watercraft, a multiple-cylinder engine is mounted such that a crankshaft extends along the front-rear direction of a body of the watercraft. In the multiple-cylinder engine of a wet-sump type, an oil tank is provided on a bottom portion of a crankcase to be integral with the crankcase to allow the oil tank and the crankcase to have a common chamber, and therefore the oil tank is elongate in the front-rear direction of the body. On the other hand, in the multiple-cylinder engine of a dry-sump type, a chamber of the oil tank is formed to be independent of a chamber of the crankcase, and, when the oil tank is provided below the engine, the oil tank is elongate in the front-rear direction of the engine. In both engines, lubricating oil inside the oil tank is fed to components of the engine that require lubrication by using a feed pump or the like.

In these engines, with reciprocation of a piston and by a blow-by gas from a combustion chamber, a pressure inside the crankcase varies. In order to inhibit the reciprocation of the piston of the engine from being impeded due to a variation in the pressure, it is required that the crankcase communicate with an ambient side to allow the variation in the pressure of the crankcase to be lessened.

More specifically, the crankcase communicates with the ambient side through a breather pipe, or the crankcase communicates with a cam chamber of a cylinder head through a cam chain tunnel and the cam chamber communicates with the ambient side through the breather pipe to allow the variation in the pressure of the crankcase to be lessened. In this case, the breather pipe communicates with, for example, an air cleaner box.

Meanwhile, a chamber of the crankcase or a cam chamber communicating with the chamber of the crankcase through a chain tunnel is full of oil mist. In order to inhibit a blow-by gas containing the oil mist from flowing into the air cleaner box through the breather pipe, a breather mechanism is typically provided with an oil separator for separating the oil mist from the blow-by gas. The blow-by gas from which the oil has been separated within the oil separator, is drawn into the air cleaner box through the breather pipe, while the oil that has been separated from the blow-by gas within the oil separator is returned to the oil tank through an oil return pipe.

The oil containing a gas is returned to the oil tank by using a scavenging pump or the like, and the gas is separated from the returned oil and reserved within the oil tank. Therefore, the oil return pipe opens inside the oil tank at a location lower than a liquid level of the oil to inhibit backflow of the reserved gas. In the personal watercraft, the oil tank is elongate in the front-rear direction of the watercraft. In some cases, during starting, stopping, and acceleration or deceleration of the personal watercraft, the oil within the oil tank moves backward and forward due to inertia, and flows back from an opening of the oil return pipe toward the oil separator.

SUMMARY OF THE INVENTION

The present invention addresses the above described conditions, and an object of the present invention is to provide a small watercraft having an oil return structure capable of inhibiting oil from flowing back from an oil tank toward an oil separator.

According to the present invention, there is provided a small watercraft comprising an engine for propelling a body of the watercraft; an oil tank configured to reserve oil for lubricating the engine; an oil separator configured to separate the oil from a blow-by gas of the engine; and an oil return passage configured to return the separated oil to the oil tank, wherein a baffle member is provided in the vicinity of an opening portion at which the oil return passage opens in the oil tank so as to inhibit the oil from moving from a predetermined direction toward the opening portion of the oil return passage within the oil tank.

In the above configuration, during starting, stopping, and acceleration or deceleration of the personal watercraft, even when the oil moves due to inertia within the oil tank, the baffle member serves to inhibit the movement of the oil from the predetermined direction to the oil return passage. Therefore, backflow of oil to the oil return passage is inhibited.

The predetermined direction may be forward or backward of the watercraft. In this configuration, during starting, stopping, and acceleration or deceleration of the small watercraft, backflow of the oil to the oil return passage is effectively inhibited.

A longitudinal direction of the oil tank may substantially correspond with a front-rear direction of the watercraft. In this configuration, the oil tank having a large volume is easily placed.

The engine may be a multiple-cylinder engine and may be mounted such that an axial direction of a crankshaft substantially corresponds with the front-rear direction of the body, and the oil tank may be disposed below the engine. In this configuration, a multiple-cylinder engine equipped with the oil tank having a large volume is easily mounted in the personal watercraft.

The oil return passage may be configured to open at a rear end portion of the oil tank, and the baffle member may be disposed forward of the opening portion of the oil return passage. Thereby, the configuration for inhibiting the oil from flowing back to the oil return passage is easily achieved.

The baffle member may be wall-shaped. The wall may serve as a separating wall of the oil tank. Further, the baffle member may be convex portion, protrusion, or the like.

According to the present invention, there is further provided a small watercraft comprising an engine for propelling a body of the watercraft; an oil tank configured to reserve the oil for lubricating the engine; an oil separator configured to separate the oil from a blow-by gas of the engine; and an oil return passage configured to return the separated oil to the oil tank, wherein the oil return passage is configured to open in the oil tank in a direction substantially perpendicular to a front-rear direction of the watercraft.

In this configuration, during starting, stopping, and acceleration or deceleration of the personal watercraft, even when the oil moves backward and forward within the oil tank, the oil is inhibited from flowing into an opening portion of oil return passage, and hence back flow of the oil to the oil return passage is inhibited.

The oil return passage may be configured to be led into the oil tank so as to extend along the front-rear direction of the watercraft and to be then bent substantially at a right angle to open in the oil tank. In this configuration, the oil return passage is easily connected to the oil tank.

The above and further objects and features of the invention will more fully be apparent from the following detailed description with accompanying drawings.

DETAILED DESCRIPTION OF THE PREFERRED EMBODIMENTS

Hereinafter, an embodiment of a personal watercraft of the present invention, which is one type of a small watercraft, will be described with reference to the drawings.

Figure 1:
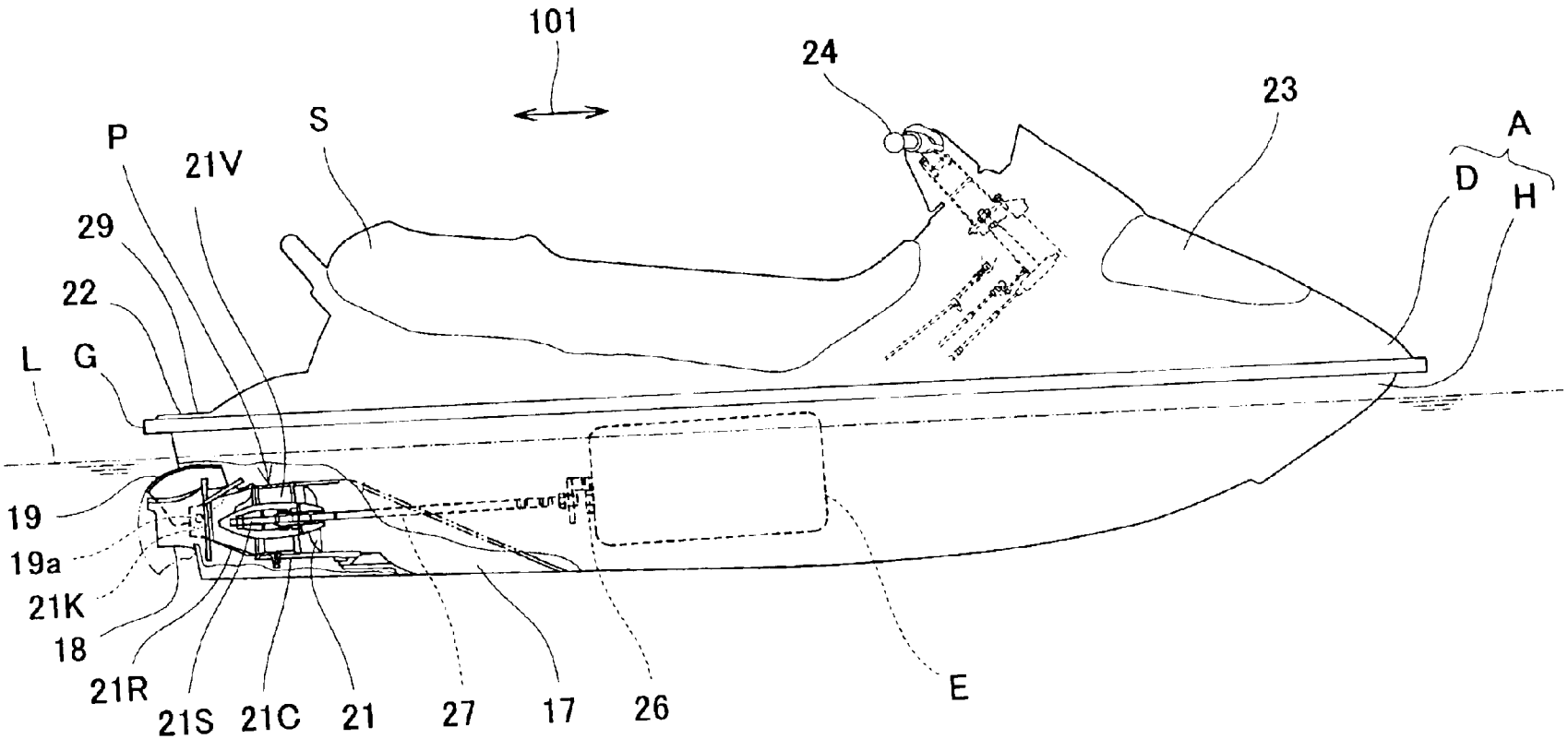
FIG. 1 is a side view of a personal watercraft according to an embodiment of the present invention.
Figure 2:
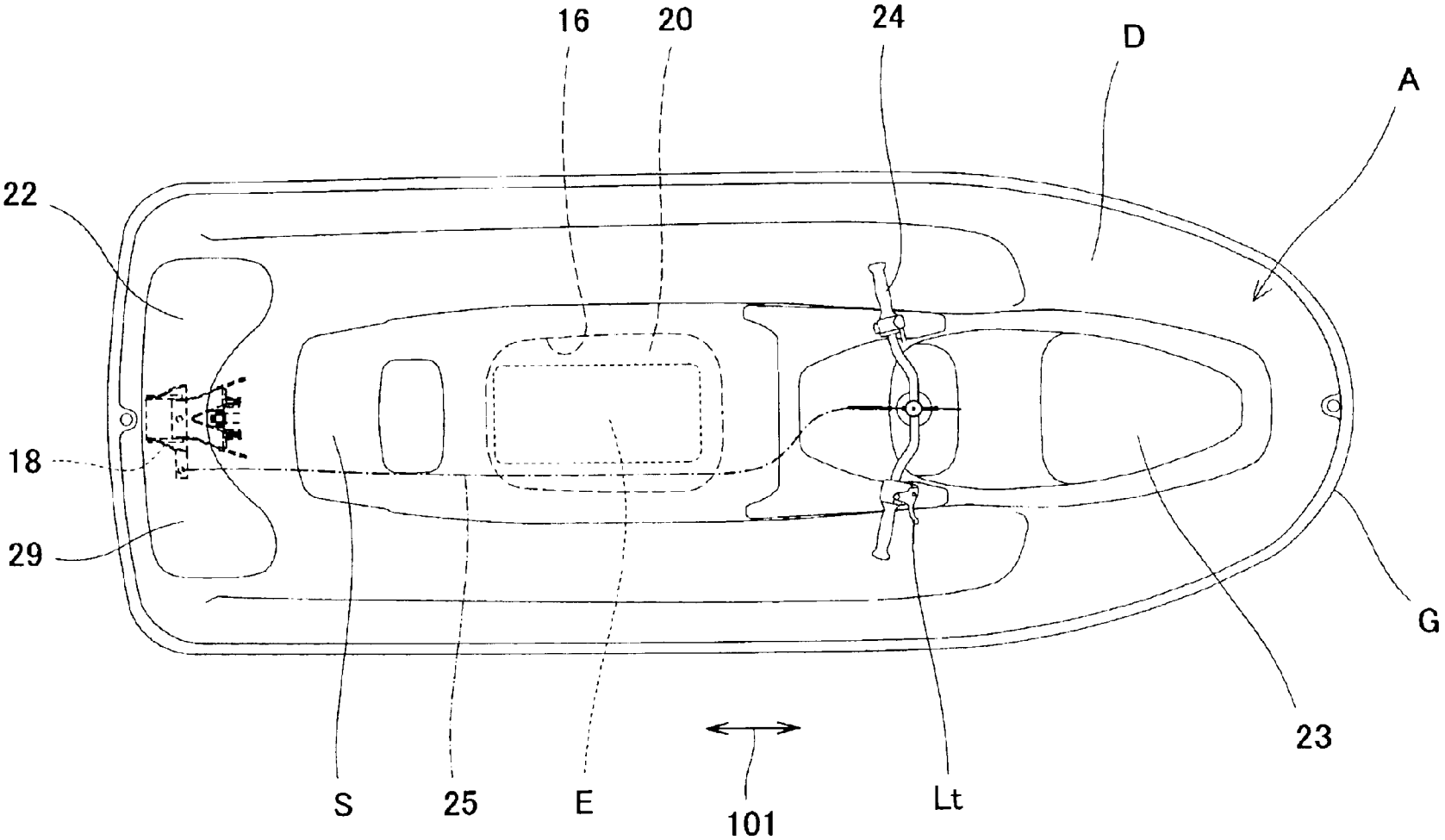
FIG. 2 is a plan view of the personal watercraft in FIG. 1.

FIG. 1 is a side view of a personal watercraft according to an embodiment of the present invention. FIG. 2 is a plan view of the personal watercraft in FIG. 1.

In FIGS. 1 and 2, reference numeral A denotes a body of the personal watercraft. The body A comprises a hull A and a deck D covering the hull H from above. A line at which the hull H and the deck D are connected over the entire perimeter thereof is called a gunnel line G. The gunnel line G is located above a waterline L of the personal watercraft.

As shown in FIG. 2, an opening 16, which has a substantially rectangular shape seen from above, is formed at a relatively rear section of the deck D such that it extends in a front-rear (i.e., fore-and-aft) direction 101 of the body A, and a riding seat S is mounted above the opening 16 such that it covers the opening 16 from above as shown in FIGS. 1 and 2. As used herein, "front-rear direction" 101 refers to both of a direction from front toward rear and a direction from rear toward front.

An engine E is contained in a engine room 20 surrounded by the hull H and the deck D below the seat S and having a convex-shape in a cross section of the body A.

In this embodiment, the engine E is a in-line multiple-cylinder (four-cylinder) four-cycle engine. As shown in FIG. 1, the engine E is mounted such that a crankshaft 26 extends along the front-rear direction of the body A. An output end of the crankshaft 26 is rotatably coupled integrally with a pump shaft 21S of a water jet pump P through a propeller shaft 27. An impeller 21 is mounted on the pump shaft 21S of the water jet pump P. The impeller 21 is covered with a pump casing 21C on the outer periphery thereof. A water intake 17 is provided on the bottom of the hull H. The water is sucked from the water intake 17 and fed to the water jet pump p through a water intake passage 28. The water jet pump P pressurizes and accelerates the water. The pressurized and accelerated water is discharged through a pump nozzle 21R having a cross-sectional area of flow that gradually reduces rearward, and from an outlet portion 21K provided on the rear end of the pump nozzle 21R, thereby obtaining the propulsion force.

In FIG. 1, reference numeral 21V denotes fairing vanes for fairing water flow inside the water jet pump P. In FIGS. 1 and 2, reference numeral 24 denotes a bar-type steering handle. By operating the steering handle 24 to the right or to the left, the steering nozzle 18 provided behind the pump nozzle 21R swings to the right or to the left through a wire cable 25 represented by a dashed line in FIG. 2. The watercraft can be turned to any desired direction while the water jet pump P is generating the propulsion force. A throttle lever Lt in FIG. 2 serves to adjust an engine speed of the engine E.

As shown in FIG. 1, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward, and, as the resulting reaction, the personal watercraft moves rearward.

In FIGS. 1 and 2, reference numeral 22 denotes a rear deck. The rear deck 22 is provided with an openable hatch cover 29. A rear compartment (not shown) with a small capacity is provided under the hatch cover 29. In FIG. 1 or 2, reference numeral 23 denotes a front hatch cover. A front compartment (not shown) is provided under the front hatch cover 23 for storing equipment and the like.

Subsequently, a structure of main components of the present invention will be described.

Figure 3:
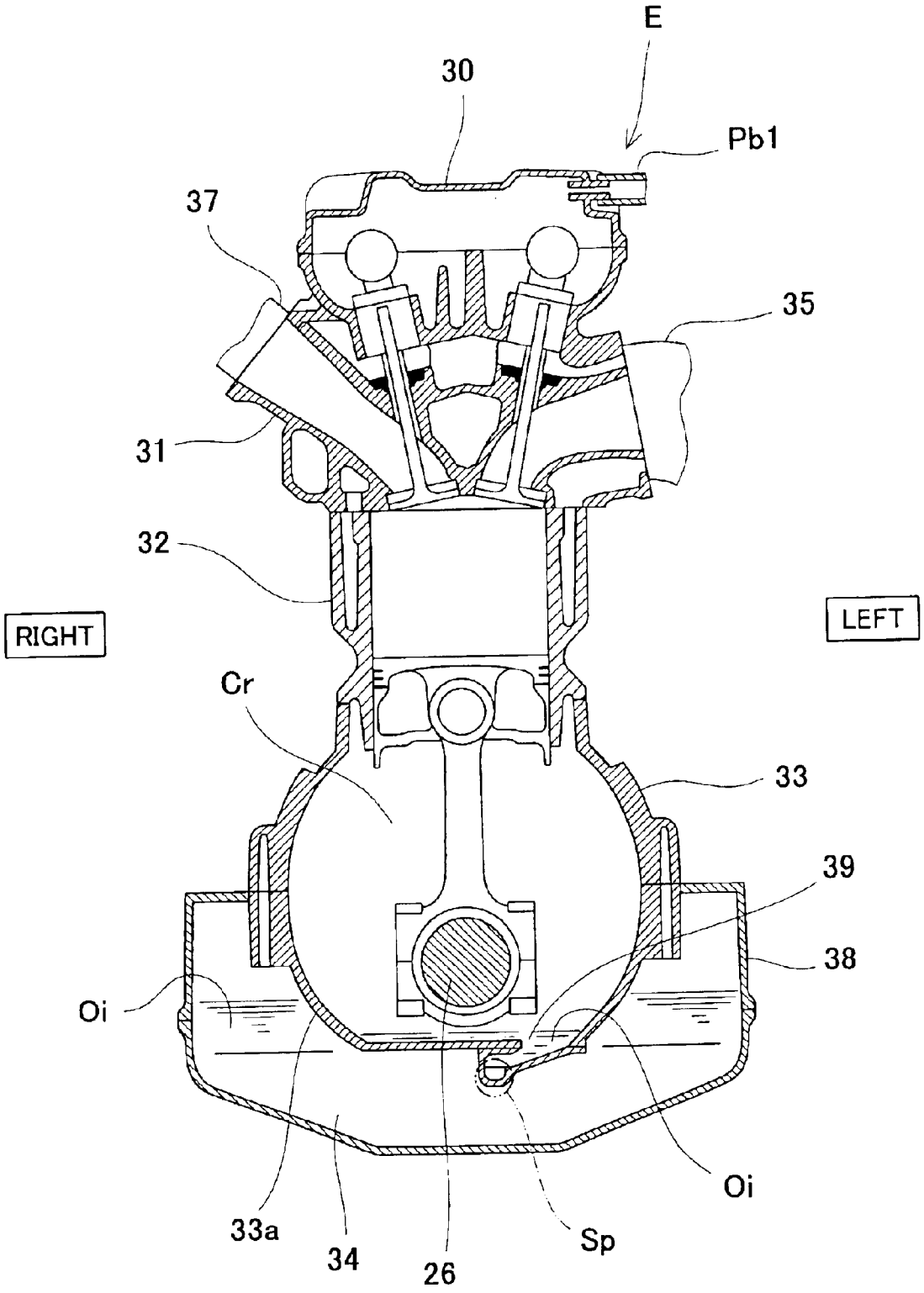
FIG. 3 is a cross-sectional view of an engine sectioned along a width direction of the personal watercraft.
Figure 4:
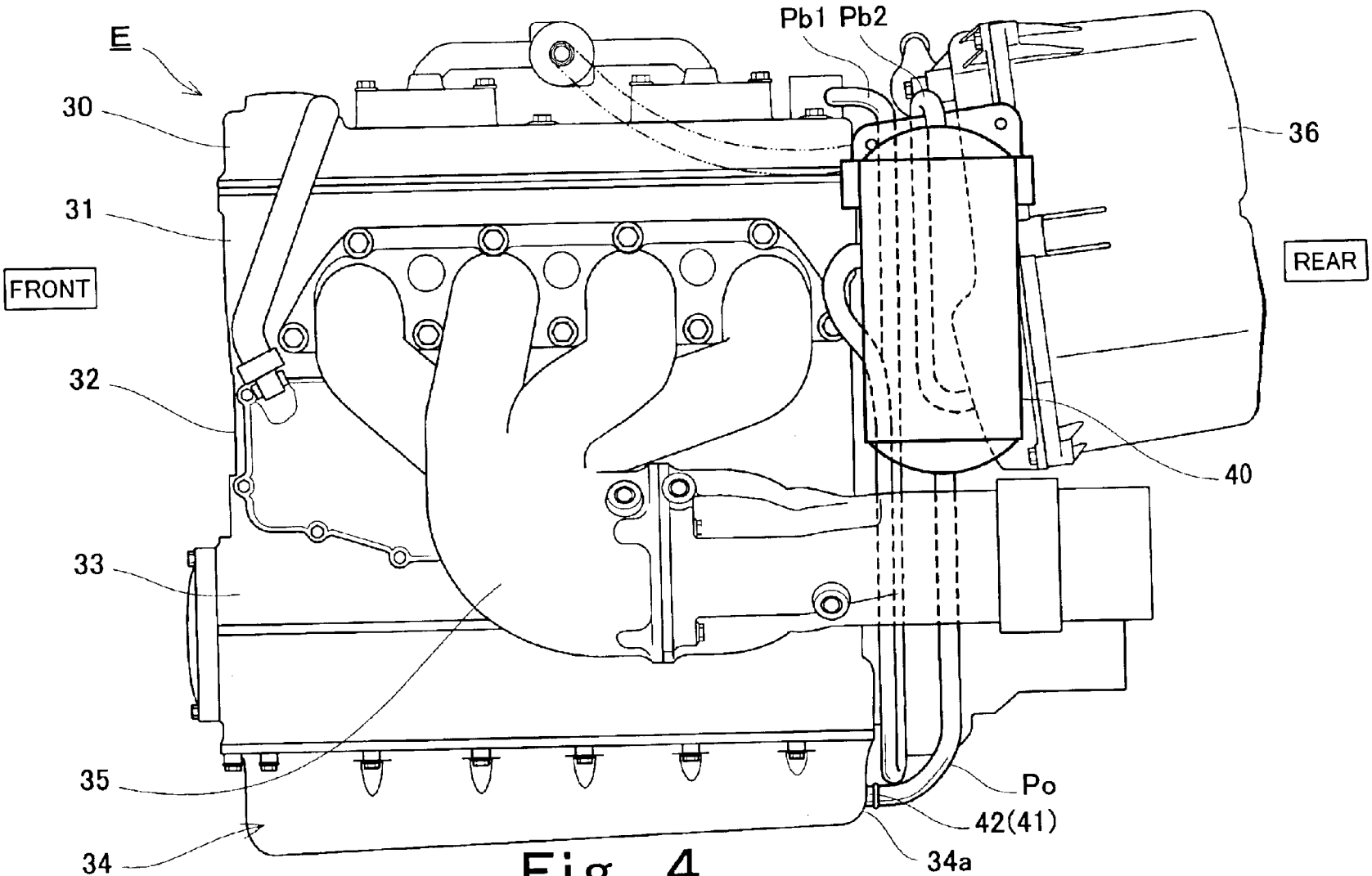
FIG. 4 is a left-side view of the engine.

FIG. 3 is a cross-sectional view of the engine sectioned along the width direction of the watercraft. FIG. 4 is a left-side view of the engine.

As shown in FIGS. 3 and 4, the engine E is mounted within an engine room 20 (see FIG. 2) such that four cylinders are arranged in the front-rear direction 101(see FIGS. 1 and 2) of the watercraft. The engine E comprises an engine body having a cylinder head 31 covered by a cylinder head cover 30, a cylinder block 32, a crankcase 33, an oil tank 34, and the like, which are arranged and connected to one another in this order, from above. The engine E further comprises an exhaust pipe 35 and an air-intake pipe 37 connected at one end to the cylinder head 31, respectively, an air cleaner box 36 disposed behind the engine body, an oil separator 40 placed behind the engine body and laterally of the air-cleaner box 36, and the like. The air cleaner box 36 is connected to the other end of the air-intake pipe 37 through an air-intake box (not shown). The oil separator 40 is connected to the cylinder head cover 30 through a first breather pipe Pb1, to the air cleaner box 36 through a second breather pipe Pb2, and to the oil tank 34 through an oil return pipe Po. The breather pipe Pb1, the oil separator 40, and the second breather pipe Pb2 form a breather mechanism, and the first breather pipe Pb1 and the second breather pipe Pb2 form a breather pipe. An inner space of the cylinder head 31 and a chamber of the crankcase 33 (crankcase chamber Cr) communicate with each other through a chain tunnel (not shown).

Figure 6:
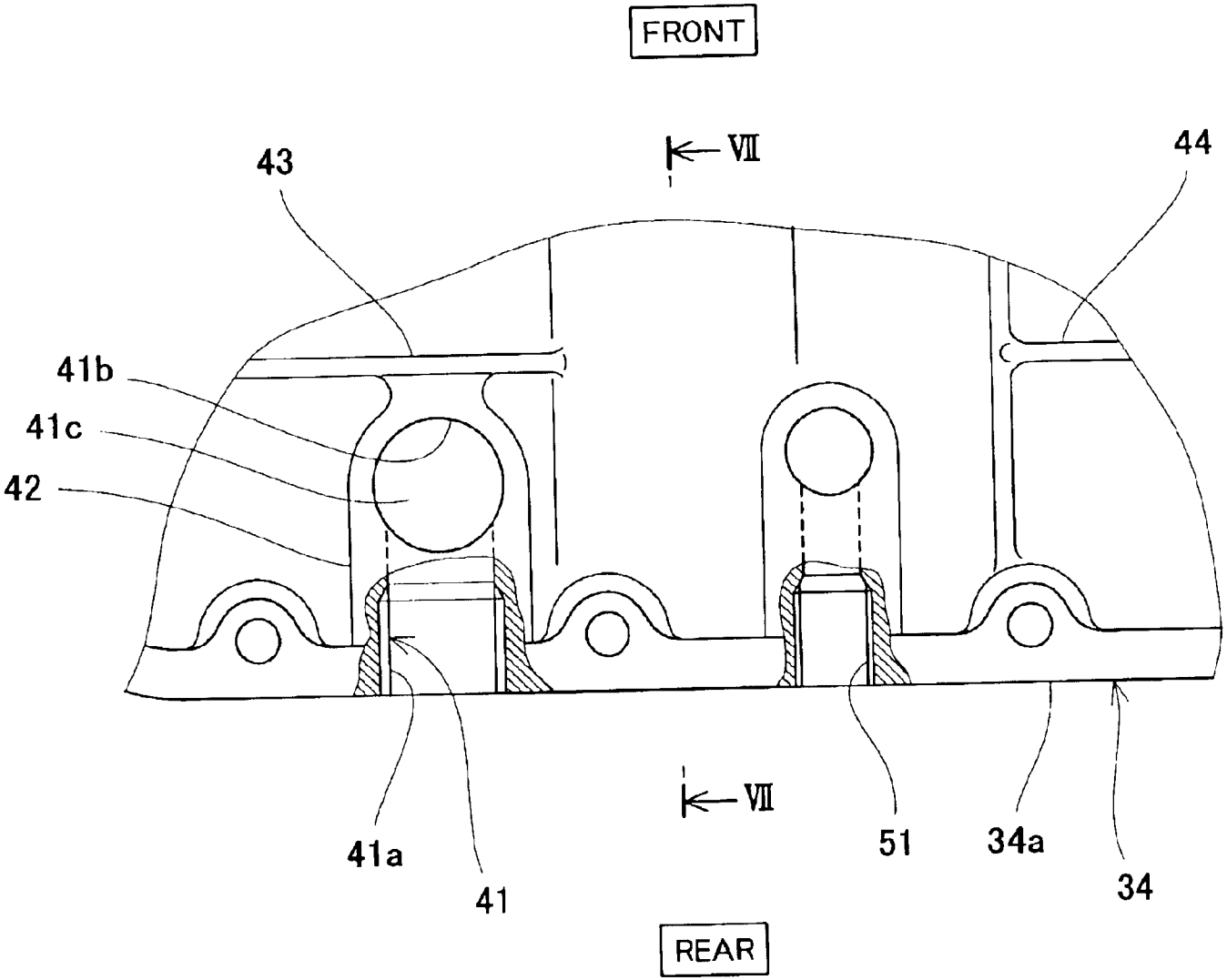
FIG. 6 is a plan view of a rear part of the oil tank taken in the direction of arrows along line VI—VI in FIG. 5, part of which is broken.

A chamber of the oil tank (hereinafter simply expressed as an oil tank chamber) 34 is configured such that a substantially lower half portion 33*a* of both side faces of the crankcase 33 of the engine E is surrounded by the oil tank case 38. That is, the oil tank chamber 34 is provided below the crankcase chamber Cr such that its longitudinal direction substantially corresponds with the axial direction of the crankshaft 36. The oil tank chamber 34 is separated from the crankcase chamber Cr by the lower half portion 33*a* of the crankcase 33, thereby forming independent closed spaces. In this embodiment, as shown in FIG. 4, the oil tank chamber 34 is substantially equal in volume to the crankcase chamber Cr, and a substantial portion of the oil tank chamber 34 is located below the engine E. In this embodiment, as shown in FIG. 4, the oil tank chamber 34 has a bottom face inclined to become higher in the direction from its front end to its rear end. Inside the oil tank chamber 34, separating (baffle) walls 43 and 44 In FIG. 6 are provided to permit backward and forward flow of the oil, but to inhibit fast flow of the oil. As shown in FIG. 3, oil Oi, that has lubricated components of the engine E, is reserved in a bottom portion of the crankcase chamber Cr. A scavenging pump Sp is provided on a bottom portion of the crankcase chamber Cr. By the scavenging pump Sp, the oil Oi reserved in the bottom portion of the crankcase chamber Cr is returned to the oil tank chamber 1.

Subsequently, a configuration of an opening portion of the oil return pipe Po extending from the oil separator 40 to the oil tank chamber 34, will be described.

Figure 5:
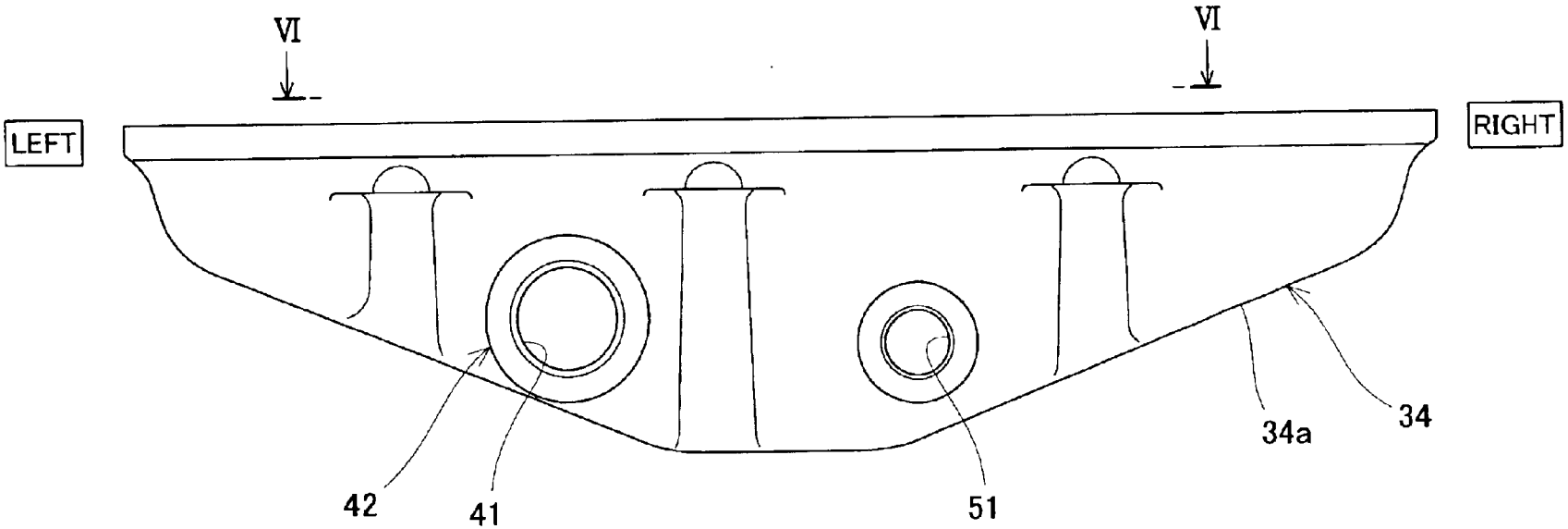
FIG. 5 is a rear view of a lower half portion of an oil tank.

FIG. 5 is a rear view of a lower half portion 34*a* of the oil tank chamber 34. FIG. 6 is a plan view of the rear part of the oil tank taken in the direction of arrows along line VI—VI in FIG. 5, and FIG. 7 is a cross-sectional view taken in the direction of arrows along line VII—VII in FIG. 6.

As shown in FIG. 5, a first oil return port 41 and a second oil return port 51 are formed on a back (rear) face of the lower half portion 34*a* of the oil tank chamber 34. As shown in FIG. 4, one end of the oil return pipe Po is connected to the oil separator 40, and the other end of the oil return pipe Po is connected to the first oil return port 41. Although not shown, one end of an oil return tube is connected to the cylinder head 30, and the other end of the oil return tube is connected to the second oil return port 51 to return the oil in the cylinder head 31 into the oil tank chamber 34.

Figure 7:
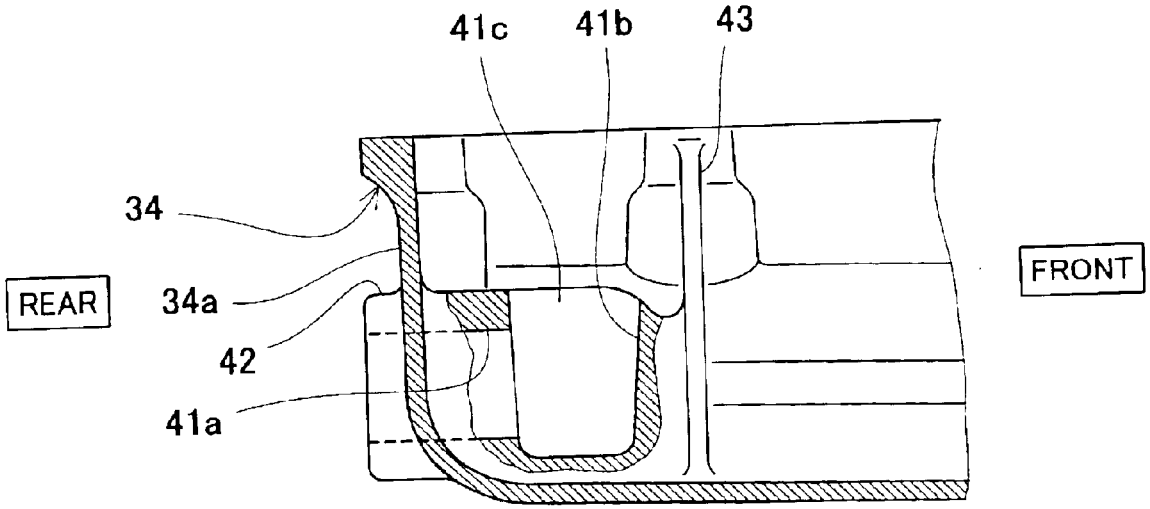
FIG. 7 is a cross-sectional view taken in the direction of arrows along line VII—VII in FIG. 6, part of which is broken.

Referring to FIGS. 5 to 7, a cylindrical boss portion 42 is formed at a location of the lower half portion 34*a* of the oil tank chamber 34 where the first oil return port 41 is provided. An inner hole 41 of the boss portion 42 forms the first oil return port 41. The boss portion 42 is configured to extend between an outer side and an inner side of the oil tank chamber 34 through a wall of the oil tank chamber 34 (oil tank case 38 in FIG. 3). The inner hole 41 is comprised of a horizontal hole 41*a* extending substantially horizontally from a rear end of the boss portion 42 so as to penetrate through the wall of the oil tank chamber 34, and a vertical hole 41*b* connected to a front end of the horizontal hole 41*a* to extend substantially vertically. The vertical hole 41*b* extends upwardly from a position below a lower end of the horizontal hole 41*a* to have a diameter that gradually increases and opens in an upper face of the boss portion 42 so as to communicate with an inside of the oil tank chamber 34. The first oil return port 41 and the oil return pipe Po form an oil return passage extending from the oil separator 40 to the oil tank chamber 34. As used herein, the direction in which the oil return passage opens refers to an axial direction of an opening portion 41*c* of the first oil return port 41. Therefore, the oil return passage opens upwardly.

The baffle wall (baffle member) 43 comprised of a rib is connected to a front end of the boss portion 42, which is located in the vicinity of the opening portion 41*c* of the oil return pipe Po. The baffle wall 43 is vertically provided on an inner bottom face of the oil tank chamber 34 to extend over a predetermined length in the lateral direction and to be higher than an upper end of the boss portion 42.

Subsequently, an operation of the personal watercraft so configured will be described.

Referring to FIGS. 3 and 4, upon start of the engine E, a piston reciprocates. With the reciprocation, an internal pressure of the crankcase chamber Cr varies due to a blow-by gas or the like. The variation in the pressure is transmitted to the cylinder head 31 through the chain tunnel, and further, transmitted to the air cleaner box 36 through the first breather pipe Pb1, the oil separator 40, and the second breather pipe Pb2. Since the air cleaner box 36 communicates with an ambient side, the variation in the pressure is lessened by the air cleaner box 36. And, when a positive pressure is generated due to the variation in the pressure, the blow-by gas containing the oil mist flows from the crankcase chamber Cr into the oil separator 40 through the chain tunnel, the cylinder head 31, and the first breather pipe Pb1. Inside the oil separator 40, the blow-by gas is separated into the oil and the gas. The separated gas flows to the air cleaner box 36 through the second breather pipe Pb2 and the separated oil is returned to the oil tank chamber 34 through the oil return pipe Po. Thereby, the blow-by gas containing the oil mist is inhibited from flowing to the air cleaner box 36.

During acceleration of the engine E, a front portion of the personal watercraft is raised. Under this condition, within the oil tank chamber 34, a liquid level is higher at the rear portion. During this time, although the oil tends to move to the rear portion of the oil tank chamber 34 due to inertia, the oil is inhibited from moving to the rear portion by the baffle wall 43 disposed forward of the opening portion 41*c* of the oil return passage. Therefore, the oil is inhibited from flowing back from the opening portion 41*c* into the oil return pipe Po. Further, since the direction in which the oil return pipe Po opens inside the oil tank chamber 34, i.e., the axial direction of the vertical hole 41*b* substantially corresponds with the vertical direction, backflow of the oil is further inhibited.

While, in the above described embodiment, the present invention is applied to a lubricating system of the dry-sump type, it also may be applied to a lubricating system of the wet-sump type.

The present invention is applicable to small watercraft other than the personal watercraft.

While the baffle plate 43 is provided and the axial direction of the opening portion 41*c* of the oil return pipe Po substantially corresponds with the vertical direction in the above described embodiment, one of these configurations may be adopted.

Instead of a solid member, the baffle wall 43 may be formed by a porous member.

Instead of the baffle member 43, a convex portion or protrusion may be provided, as a baffle member for inhibiting the flow of the oil.

The axial direction of the opening portion 41*c* of the oil return pipe Po may be substantially perpendicular to the front-rear direction of the watercraft rather than the vertical direction.

The oil return pipe Po may be connected to the oil tank chamber 34 from a direction other than from rear of the watercraft.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A small watercraft comprising:

an engine disposed such that an axial direction of a crankshaft thereof substantially corresponds with a front-rear direction of the watercraft, the engine being configured to propel a body of the watercraft;

an oil tank provided below the engine such that a longitudinal direction of the oil tank substantially corresponds with the front-rear direction of the body, the oil tank being configured to reserve oil for lubricating the engine;

an oil separator configured to separate the oil from a blow-by gas of the engine; and an oil return passage configured to return the separated oil to the oil tank through an oil pipe;

wherein one end of the oil pipe is connected to the separator and an opposite end thereof is connected to a return port provided on a rear wall of the oil tank; and wherein the return port has a rear end connected to the oil pipe and is provided with a first hole extending forward in the front-rear direction of the watercraft and substantially horizontally from the rear end, and a second hole extending from the first hole in a direction to form substantially a right angle with respect to the first hole and is configured to have an opening which opens in a direction to form substantially a right angle with respect to the longitudinal direction of the oil tank within the oil tank.

2. The small watercraft according to claim 1, wherein a baffle member is provided in the vicinity of the second hole within the oil tank to extend substantially in parallel with the second hole and to cover a region in front of the opening of the second hole from a forward side of the opening, relative to the front-rear direction of the watercraft.

3. The small watercraft according to claim 1, wherein the second hole is configured to extend substantially vertically from the first hole and to open upwardly.

4. The small watercraft according to claim 3, wherein the baffle member is provided to extend from a bottom wall of the oil tank beyond the opening of the second hole.

5. A small watercraft comprising:

an engine configured to propel a body of the watercraft;

an oil tank configured to reserve oil for lubricating the engine;

an oil separator configured to separate the oil from a blow-by gas of the engine; and an oil return passage configured to return the separated oil to the oil tank through an oil pipe;

wherein one end of the oil pipe is connected to the separator and an opposite end thereof is connected to a return port provided on a rear wall of the oil tank; and wherein the return port is configured to guide oil through a wall of the oil tank in a first direction, and release oil into the tank in a second direction that is different from the first direction.

6. The small watercraft of claim 5, wherein the return port includes an upstream end that is connected to the oil pipe and configured to guide oil into the tank in a first direction, a bend formed within the oil tank and downstream of the upstream end that is configured to change a flow direction of the oil flowing into the oil tank, and a downstream end formed downstream of the bend, which is configured to release the oil into the oil tank in a second direction that is different from the first direction.

7. The small watercraft of claim 6, wherein the first and second directions are oriented at substantially a right angle relative to each other.

8. The small water craft of claim 5, further comprising:

a baffle member positioned within the oil tank adjacent a downstream end of the return port.

9. The small water craft of claim 8, wherein the baffle member is formed in a location such that the downstream end of the return port is positioned intermediate the baffle member and the upstream end of the return port.

10. The small water craft of claim 9, wherein the baffle member is extended along an axial direction of the downstream end of the return port.

11. The small water craft of claim 10, wherein the baffle member includes a surface that is substantially orthogonal to the first direction of oil flow.

* * * * *